US005603666A

United States Patent [19]

Bowe

[11] Patent Number: 5,603,666

[45] Date of Patent: Feb. 18, 1997

[54] GOLF PUTTER

[76] Inventor: James E. Bowe, 25862 Valley Dr., Bettendorf, Iowa 52722

[21] Appl. No.: 525,172

[22] Filed: Sep. 8, 1995

[51] Int. Cl.[6] ..... A63B 53/02; A63B 53/04

[52] U.S. Cl. ..... 473/307; 473/313; 473/336; 473/340

[58] Field of Search ..... 273/167 R, 170, 273/171, 172, 173, 80.1, 80.2, 80 C, 80 R, 167 G, 193 R, 194 R, 169, 167 F, 167 H; 403/362, 90, 76; 15/176.1, 176.6; 473/305–315, 324–350, 251, 256, 282

[56] References Cited

U.S. PATENT DOCUMENTS

| | | | |
|---|---|---|---|
| 749,174 | 1/1904 | Davis | 273/79 |
| 1,334,189 | 3/1920 | Swanson | 273/80.1 |
| 1,352,020 | 9/1920 | Olson . | |
| 1,599,336 | 9/1926 | Lindgren | 273/80.1 |
| 1,610,802 | 12/1926 | McNair | 273/80.1 |
| 2,214,356 | 9/1940 | Wettlaufer . | |
| 3,096,982 | 7/1963 | Bassin | 273/171 |
| 3,204,962 | 9/1965 | McCormick | 273/80.1 |
| 3,214,170 | 10/1965 | Warnock | 273/171 |
| 3,423,089 | 1/1969 | Andis . | |
| 3,430,957 | 3/1969 | Andis . | |
| 3,909,005 | 9/1975 | Piszel | 273/80.1 |
| 3,979,122 | 9/1976 | Belmont | 273/171 |
| 4,881,737 | 11/1989 | Mullins . | |
| 5,046,740 | 9/1991 | D'Eath . | |
| 5,121,922 | 6/1992 | Harsh, Sr. . | |
| 5,193,806 | 3/1993 | Burkly | 273/80.2 |
| 5,244,210 | 9/1993 | Au . | |
| 5,390,918 | 2/1995 | Meyers | 273/80.1 |
| 5,423,545 | 6/1995 | Narry | 273/80 C |
| 5,462,279 | 10/1995 | Culpepper | 273/167 G |

*Primary Examiner*—Sebastiano Passaniti
*Attorney, Agent, or Firm*—Zarley, McKee, Thomte, Voorhees & Sease

[57] ABSTRACT

A golf putter has a putter head having forward, rearward, top and bottom surfaces, and opposite ends. A cavity opening is centrally located in the top surface of the putter head. An elongated shaft with a ball on the lower end thereof extends into the cavity. A detent on the ball engages a detent in the bottom of the cavity to prevent the longitudinal axis of the golf shaft from forming an angle of less than 10 degrees with a vertical axis extending upwardly from the cavity and the putter head. The shaft is locked within the putter head by three screws. Two opposite screws extend into the cavity from a threaded longitudinal bore which extends through the putter head. A second transverse screw extends into the cavity through the putter head. When tightened, the three screws mechanically lock the ball on the lower end of the shaft in the desired position. Weight elements are placed in the longitudinal bore through the putter head, and screws in the outer ends of the bore bear against the balls to fix them into position within the bores. The density of the balls can vary to permit a plurality of weight distribution characteristics.

12 Claims, 4 Drawing Sheets

GOLF PUTTER

BACKGROUND OF THE INVENTION

Golf putting is a very delicate activity, and there are hundreds of different golf putters of varying sizes and configurations to meet the most subtle needs of every golfer. Among variations in golf putters are the angle that the shaft is disposed with respect to the putter head. A further variation is the balance of the putter wherein the concentration of weight in the putter head is at one place or another.

Some putters have been designed to permit the angular disposition of the shaft with respect to the putter head to be selectively changed. Other putters have provided means for altering the weight balance of a given putter by interchanging and redistributing various weight elements.

However, the putters of the prior art are often difficult to alter with respect to changing the angle of disposition of the shaft, or to alter the disposition of weight. Many of these putters do not satisfy certain golfing regulations. For example, a putter which will permit the axis of the shaft to be at an angle of less than 10 degrees from a vertical axis extending upwardly out of the putter head are not considered to be in compliance.

Therefore, it is a principal object of this invention to provide a golf putter which can have its weight distribution easily altered and which can have the angle of inclination of the shaft with respect to the putter head selectively changed.

A further object of this invention is to provide a golf putter which can have the angle of disposition of the shaft with respect to the putter head changed, but which will limit the change to the lawful parameters of golfing regulations.

A still further object of this invention is to provide a golf putter wherein the shaft may be adjustably inclined with respect to the putter head, but wherein a locking mechanism is utilized which will absolutely insure that the shaft will not become loosened or disengaged from the putter head.

A still further object of this invention is to provide a golf putter which can have the angle of inclination of the shaft with respect to the putter head easily and quickly changed, and which can also have the weight distribution of the putter quickly and easily altered, all within the skill and abilities of the average golfer.

These and other objects will be apparent to those skilled in the art.

SUMMARY OF THE INVENTION

The golf putter of this invention has a putter head having forward, rearward, top and bottom surfaces, and opposite ends. A cavity opening is centrally located in the top surface of the putter head. An elongated shaft with a ball on the lower end thereof extends into the cavity. A detent on the ball engages a detent in the bottom of the cavity to prevent the longitudinal axis of the golf shaft from forming an angle of less than 10 degrees with a vertical axis extending upwardly from the cavity and the putter head.

The shaft is locked within the putter head by three screws. Two opposite screws extend into the cavity from a threaded longitudinal bore which extends through the putter head. A second transverse screw extends into the cavity through the putter head. When tightened, the three screws mechanically lock the ball on the lower end of the shaft in the desired position.

Weight elements are placed in the longitudinal bore through the putter head, and screws in the outer ends of the bore bear against the balls to fix them into position within the bores. The density of the balls can vary to permit a plurality of weight distribution characteristics.

Alternate forms of the invention provide that the shaft is permanently affixed at a predetermined angle to the putter head at a location in between the sets of balls in opposite bores at opposite ends of the putter head. A further alternate form of the invention provides that the detent on the lower end of the shaft extends into a small well in the bottom of the cavity with the side walls of the well governing the range of motion of the detent, and hence the angular position of the shaft.

DESCRIPTION OF THE PREFERRED EMBODIMENT

Figure 1:
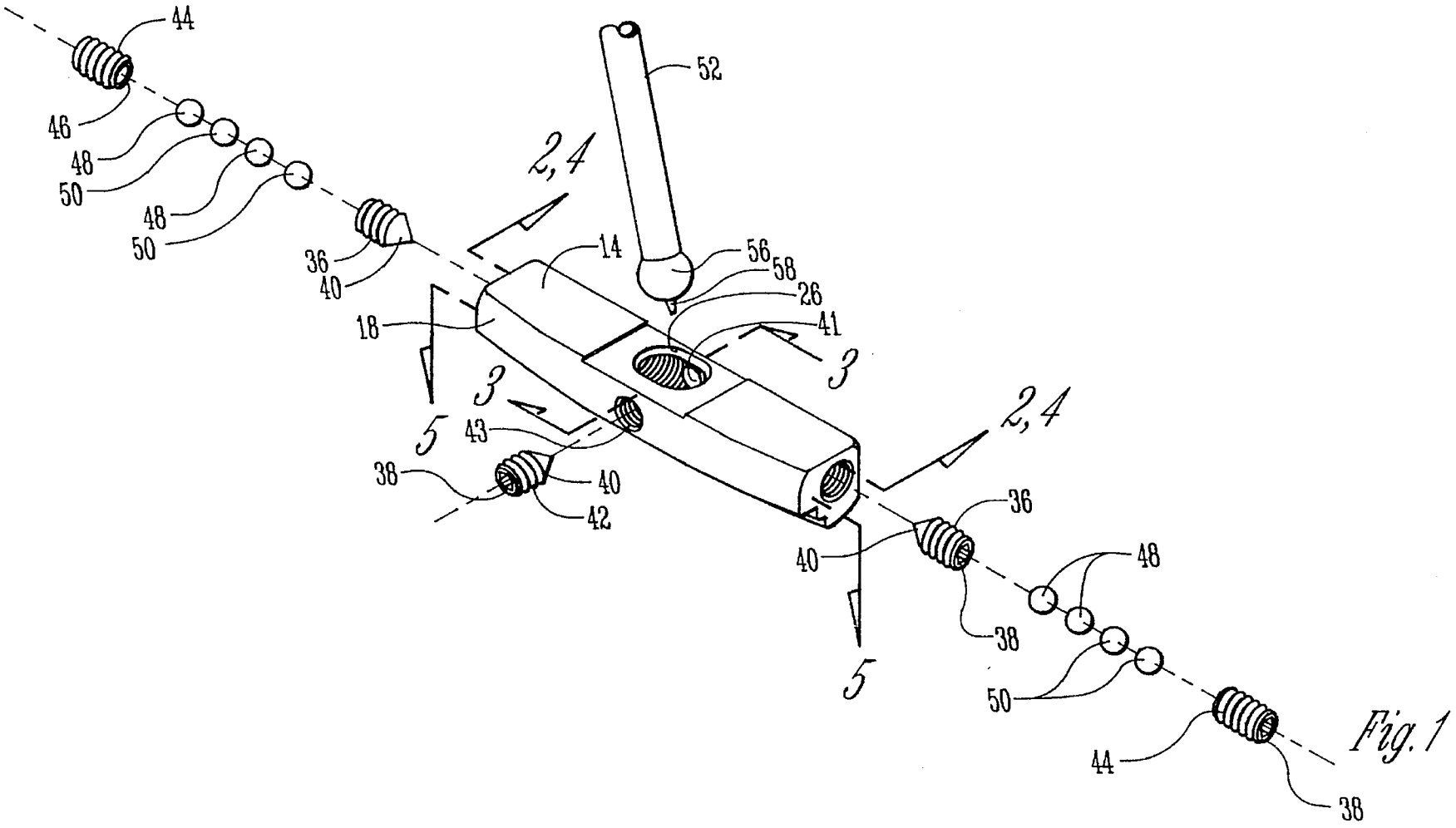
FIG. 1 is an exploded view of the preferred embodiment of the invention.

With reference to FIGS. 1, 2, 5 and 6, the golf putter 10 is comprised of a putter head 12 having a top 14, front 16, rear 18, and opposite ends 20. The putter head 12 has an elongated longitudinal axis 22 (FIG. 2) and a center vertical axis 24. A frusto-conical shaped cavity 26 extends downwardly into the center of putter head 12. A transverse detent 28 (FIGS. 2 and 6) extends upwardly from the bottom 30 of cavity 26.

Figure 2:
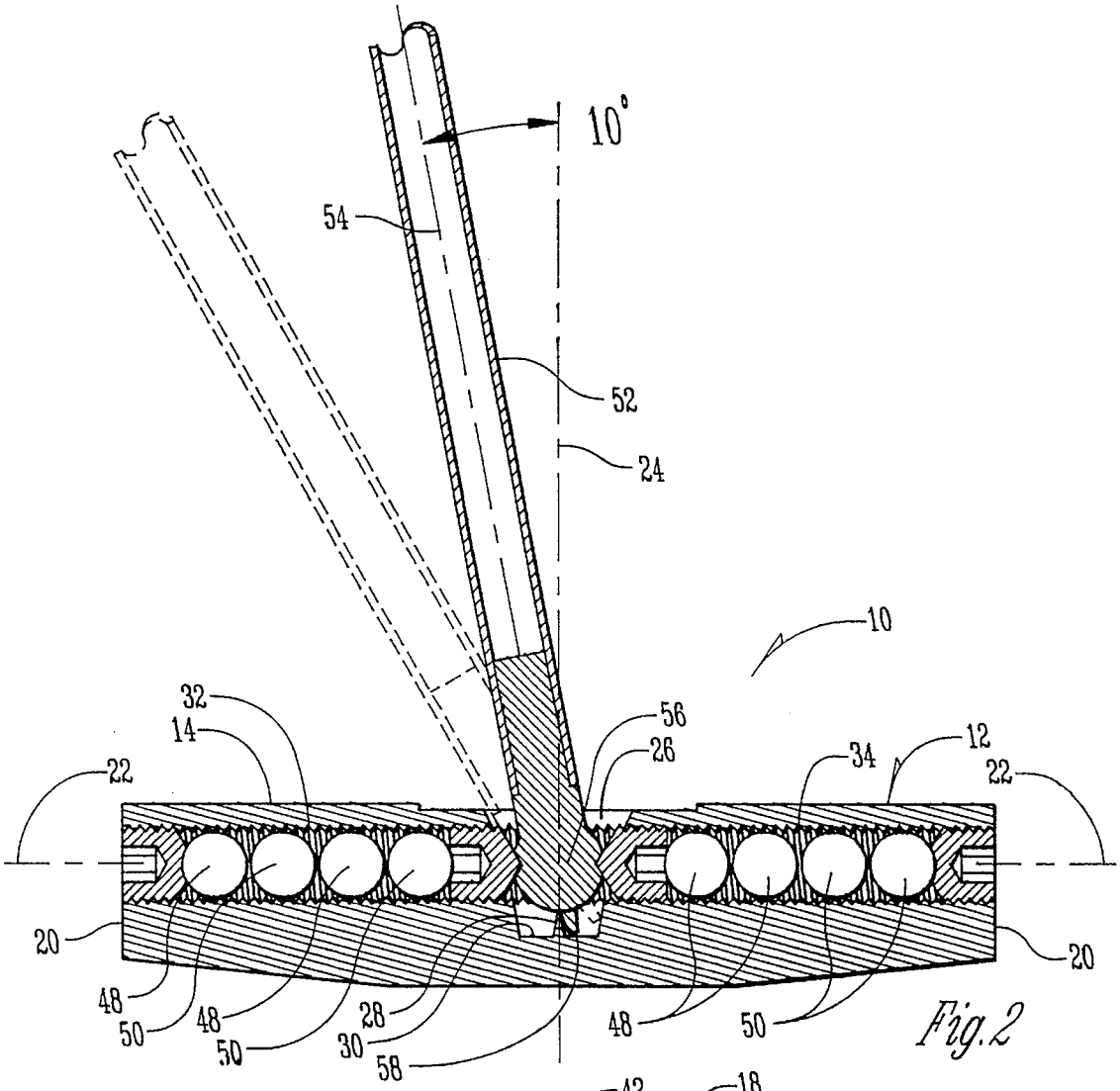
FIG. 2 is an enlarged scale sectional view of the assembled device of FIG. 1 taken on line 2—2 of FIG. 1.
Figure 5:
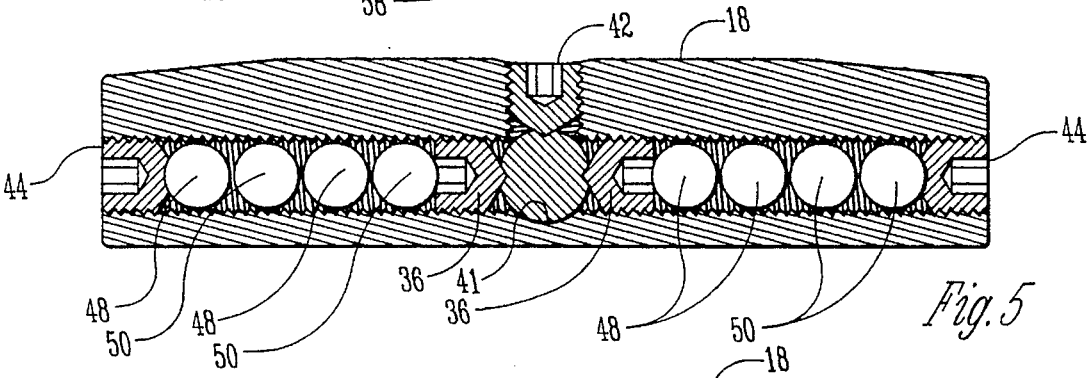
FIG. 5 is a sectional view of the assembled golf putter of FIG. 1 taken on line 5—5 of FIG. 1.
Figure 6:
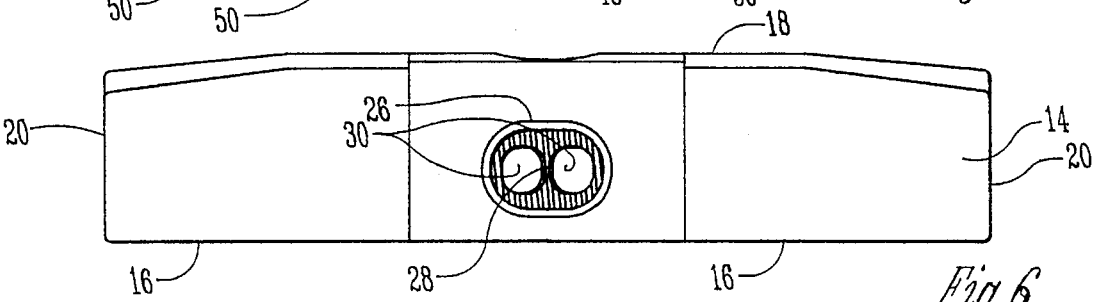
FIG. 6 is a plan view of the putter head shown in FIG. 2.

A threaded bore 32 and a threaded bore 34 extend inwardly along the longitudinal axis 22 of putter head 12 and communicate with cavity 26. With reference to FIGS. 1, 2 and 5, allen screws 36 having a socket 38 in an outer end and a cone point 40 on the other end are threaded into the bores 32 and 34 so that the cone points 40 penetrate slightly into the cavity 26. Sockets 38 are adapted to receive an allen wrench or the like for tightening or removable purposes. The allen screws 36 are moved to the positions shown in FIGS. 2 and 5 by threadably inserting them through the outer ends of the bores 32 and 34. As shown in FIGS. 1 and 5, an arcuate or spherical socket 41 is formed on one side wall of cavity 26. Allen screw 42 extends transversely into putter head 12 and communicates with the interior of the cavity through threaded aperture 43. Allen screw 42 is identical to allen screws 36.

Allen screws 44 are threaded into the outer ends of bores 32 and 34. Screws 46 are similar to the screws 36 and 42 except that cup points 46 appear on their inner ends rather than cone points 40 as are present on the allen screws 36 and 42.

Steel balls 48 and plastic balls 50 can be selectively inserted into each of the bores 32 and 34. The steel balls 48 have a density greater than that of the plastic balls. The balls in the two bores can be interchanged to achieve whatever weight distribution is desired by the golfer. The balls are inserted into the respective bores by removal of the screws 44. The screws 44 are replaced after the balls are inserted in the bores, and the screws 44 are tightened against the balls so as to maintain them in a fixed position.

Shaft 52 (FIG. 2) has a longitudinal axis 54. A spherical ball of malleable material, such as any relatively soft metal, is secured to the lower end of shaft 52. A detent 58 extends downwardly from the center of ball 56 (FIGS. 1 and 2) and is adapted to engage the detent 28 to limit the minimum angle between the longitudinal axis 54 of the shaft and the vertical axis 24 extending upwardly out of the putter head to 10 degrees. As shown by the dotted lines in FIG. 2, the angle of the shaft 52 can be greater than 10 degrees, but the engagement between the detents 28 and 58 prevents that minimum angle from being any less than 10 degrees. Thus, it is not possible for the golfer to adjust the angle of the shaft to encroach on this 10 degree angle and thus make the putter illegal by golfing standards.

In operation, with the balls 48 and 50, and the screws 44 removed from the bores 32 and 34, the ball 56 on the lower end of the shaft is lowered into the socket 26. If the screws 36 are in the bores, they must be backed off to permit the ball 56 to be freely lowered into the cavity 26. This is also true of screw 42. By stabilizing the putter head 12, and holding the shaft in the preferred angle of disposition with respect to the putter head, the screws 36 and 42 are selectively tightened so that the cone points 40 thereon mechanically engage and slightly penetrate the ball 56 to hold the shaft in rigid angular position with respect to the putter head. Again, the engagement of detents 28 and 58 prevents the shaft from forming an angle of less than 10 degrees with respect to the vertical axis 24 extending upwardly out of the center of the cavity.

The putter is then balanced in accordance with the wishes of the golfer by inserting various of the balls 48 and 50 into each of the bores 32 and 34. The balls are then maintained within the bore by reinserting the screws 44 as described heretofore.

Figure 4:
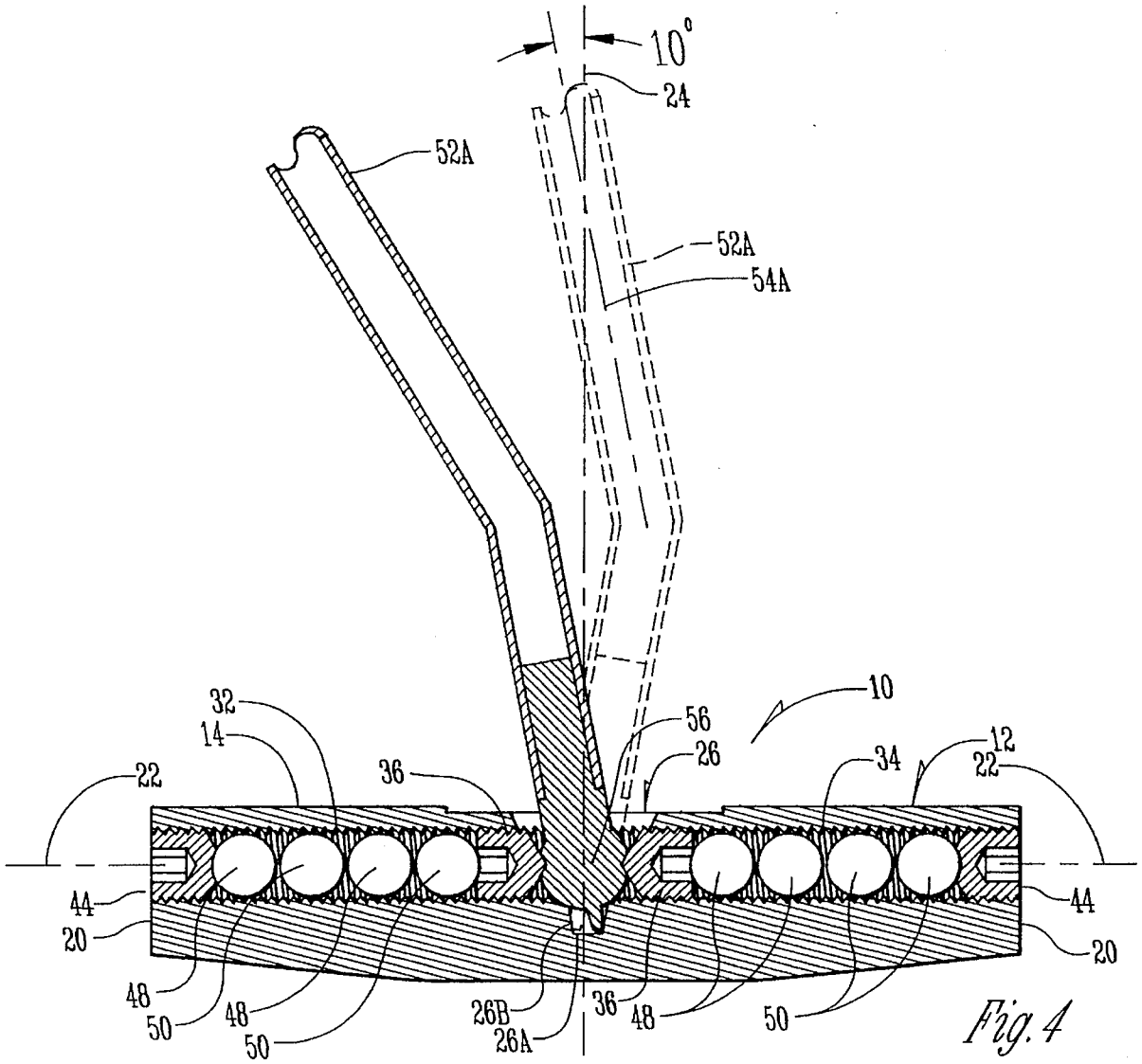
FIG. 4 is a sectional view similar to that of FIG. 2 but shows an alternate-shaped putter shaft.
Figure 3:
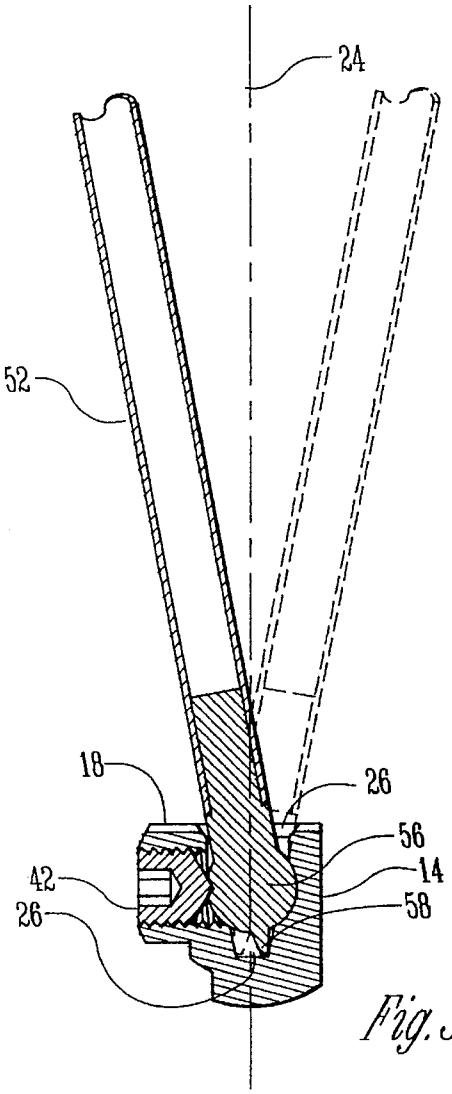
FIG. 3 is a transverse sectional view of the assembled golf putter of FIG. 1 taken on line 3—3 of FIG. 1.

The alternative form of the invention shown in FIGS. 3 and 4 modifies the structure described heretofore in that the cavity 26 has a tapered well 26A in the bottom thereof. The well 26A has a tapered side wall 26B. A shaft 52A which may have a conventional bend therein has the same ball configuration on its lower end as did shaft 52. The detent 58 thereon is adapted to engage the side wall 26B of well 26A to limit the angle between vertical axis 24 and axis 56A to a minimum of 10 degrees.

It should be noted that both of the putters in FIGS. 2 and 4 can be adapted for use by either right or left hand golfers. In the case of the putter 10 in FIG. 2, the detent 58 would be located on the left hand side of the detent 28 to accommodate a left handed golfer. In the case of the structure of FIG. 4, the detent 58 would engage the left hand side of the well 26A to accommodate a left handed golfer.

Figure 7:
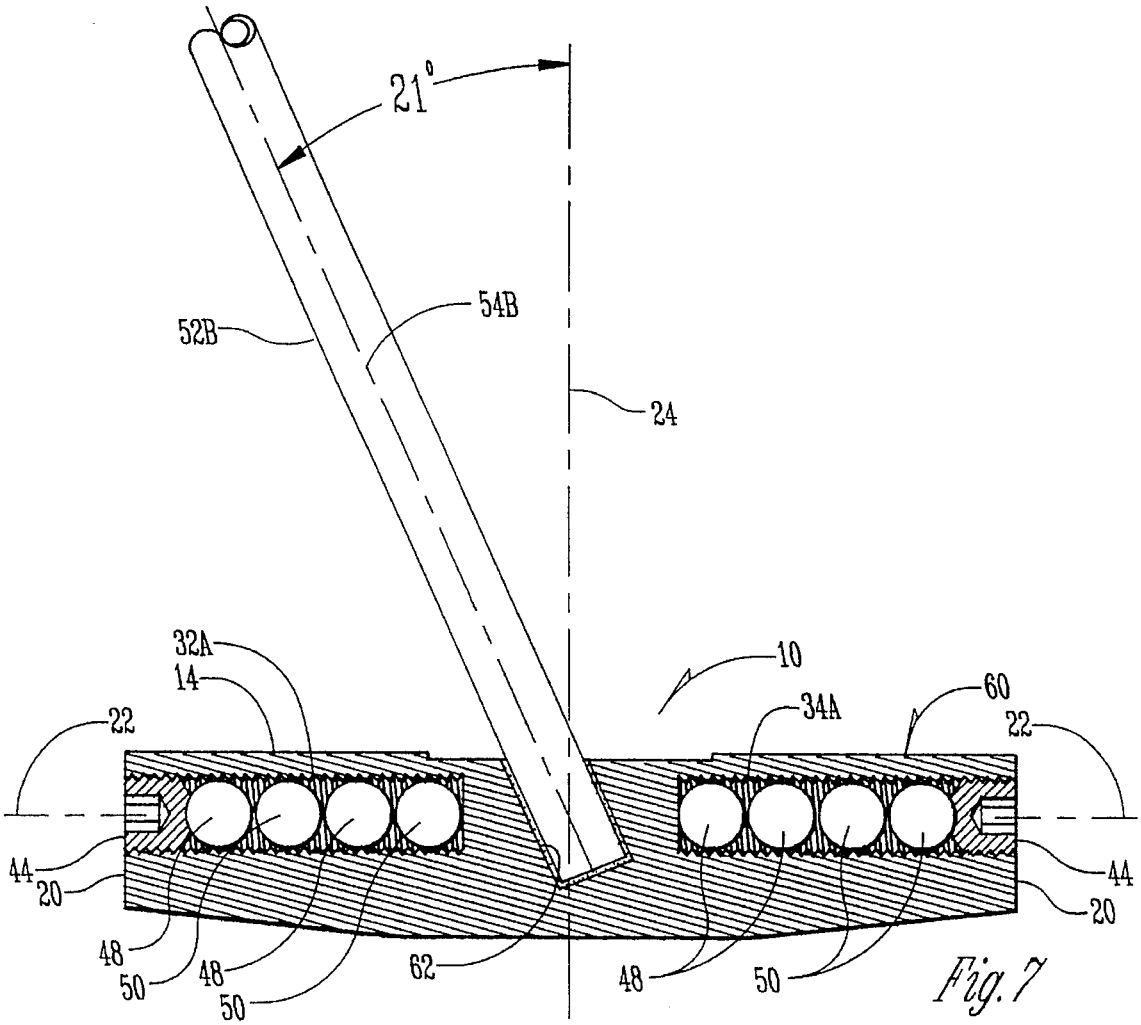
FIG. 7 is a sectional view similar to FIG. 2 but shows an alternate form of the invention wherein the putter shaft is fixed in one position with respect to the putter head.

In regard to FIG. 7, a modified putter head 60 is shown which has an angular aperture 62 therein to receive the lower end shaft of 52B. The shaft 52B does not have a ball structure on the lower end thereof. A suitable epoxy or the like can be placed in aperture 62 to rigidly secure the lower end of shaft 52B in place.

The bores 32A and 34A in FIG. 7 are identical to bores 32 and 34, respectively, as shown in FIG. 2, except that the inner ends thereof are closed and do not utilize the allen screws 36.

From the foregoing, it is seen that the devices of this invention will achieve at least all of the stated objectives.

What is claimed is:

1. A golf putter, comprising, a putter head having forward, rearward, top and bottom surfaces, and opposite ends, a centrally located cavity in said top surface, an elongated shaft having a longitudinal axis and upper and lower ends with the lower end of said shaft extending into said cavity, locking means in said putter head rigidly locking said shaft in an angular position in said cavity, opposite elongated bores extending inwardly from the ends of said putter head towards the position of said cavity, said locking means comprising two first screws threaded into said bores and mechanically gripping the lower end of said shaft, and a second screw threaded in an aperture in said putter head and mechanically gripping the lower end of said shaft, said cavity having a volume greater than the lower end of said shaft positioned therein whereby the position of said lower end in said cavity can be adjusted by adjusting said first and second screws to thereby adjust the angular position of said shaft with respect to said putter head.

2. The golf putter of claim 1 and further including positioning means having a detent in said cavity and a detent on the lower end of said shaft positioned with respect to each other so that the longitudinal axis of said shaft cannot be positioned with respect to said vertical axis at an angle of less than ten degrees because of the physical engagement of said detents.

3. The golf putter of claim 2 wherein the detent on the end of said shaft extends from a spherical shaped ball on the end of said shaft.

4. The golf putter of claim 1 wherein said first and second screws have cone points thereon to engage and penetrate the lower end of said shaft when tightened thereagainst.

5. The golf putter of claim 4 wherein said first and second screws have a socket in the end thereof opposite said cone points for receiving a tightening tool.

6. The golf putter of claim 1 wherein said second screw is threaded in an aperture that has an axis transverse to the axis of said bore into which said first screws are threaded.

7. The golf putter of claim 1 wherein a malleable ball is secured to the lower end of said shaft, and said first and second screws are tightened against said ball.

8. The golf putter of claim 1 wherein said second screw is threaded in an aperture that has an axis transverse to the axis of said bore into which said first screws are threaded, a malleable ball is secured to the lower end of said shaft, and said first and second screws are tightened against said ball.

9. The golf putter of claim 1 wherein said second screw is threaded in an aperture that has an axis transverse to the axis of said bore into which said first screws are threaded, a malleable ball is secured to the lower end of said shaft, and said first and second screws are tightened against said ball, and a spherical notch is in said cavity opposite to the inner end of said second screw to permit said second screw to force said ball into tight engagement with said notch.

10. The golf putter of claim 1 and further including positioning means having a spherical shaped ball on the lower end of said shaft with a detent on said ball, the shape of said cavity being such that when said ball is located within said cavity, said detent will engage said cavity to prevent said shaft from assuming a position with respect to said vertical axis of less than ten degrees.

11. A golf putter comprising, a putter head having forward, rearward, top and bottom surfaces, and opposite ends, a centrally located cavity in said top surface, an elongated shaft having a longitudinal axis and upper and lower ends with the lower end of said shaft extending into said cavity, variable positioning means in said cavity to prevent said shaft from assuming a position with respect to a vertical axis extending upwardly from said cavity and said putter head at ten degrees or less, locking means in said putter head rigidly locking said shaft in an angular position in said cavity, said positioning means including a well in the bottom of said cavity, said well having a side wall, and a detent on the lower end of said shaft penetrating said well and engaging the side wall of said well, the breadth of said well being such that when said detent engages the side walls thereof, the longitudinal axis of said shaft will be at an angle of ten degrees or more with respect to a vertical axis extending upwardly from said cavity and said well.

12. A golf putter comprising, an elongated putter head having forward, rearward, top and bottom surfaces, and a center portion centrally located between said ends, an elongated shaft secured to said head, separate and opposite aligned elongated bores of equal length and diameter, and of uniform diameter, extending inwardly from the ends of said putter head towards said center portion and terminating in spaced relation to each other, identically shaped removable closure elements in said elongated bores adjacent to and coinciding with the ends of said head extending inwardly from the ends of said head, and an equal number of detachable spherically and identically shaped weight elements longitudinally aligned in a single row and rigidly positioned in each of said bores by said closure elements, some of said weight elements being of a lesser weight than other of said weight elements, said weight elements having a diameter substantially equal to the diameter of said bores to permit only longitudinal movement of said weight elements in said bores when said closure elements are removed.

* * * * *